US008151943B2

(12) United States Patent
de Groot

(10) Patent No.: US 8,151,943 B2
(45) Date of Patent: Apr. 10, 2012

(54) METHOD OF CONTROLLING INTELLIGENT DESTINATION ELEVATORS WITH SELECTED OPERATION MODES

(76) Inventor: Pieter J. de Groot, Meggen (CH)

( * ) Notice: Subject to any disclaimer, the term of this patent is extended or adjusted under 35 U.S.C. 154(b) by 781 days.

(21) Appl. No.: 12/194,121

(22) Filed: Aug. 19, 2008

(65) Prior Publication Data

US 2009/0050417 A1 Feb. 26, 2009

Related U.S. Application Data

(60) Provisional application No. 60/957,032, filed on Aug. 21, 2007.

(51) Int. Cl.
*B66B 1/18* (2006.01)

(52) U.S. Cl. ..... 187/382; 187/391

(58) Field of Classification Search ..... 187/247, 187/380–389, 391–393
See application file for complete search history.

(56) References Cited

U.S. PATENT DOCUMENTS

| | | | | |
|---|---|---|---|---|
| 3,561,571 | A | 2/1971 | Gingrich | |
| 3,589,472 | A * | 6/1971 | Hallene et al. | 187/386 |
| 3,625,311 | A | 12/1971 | Nowak et al. | |
| 3,682,275 | A | 8/1972 | Loshbough et al. | |
| 3,740,709 | A | 6/1973 | Savino | |
| 3,807,531 | A | 4/1974 | Mandel | |
| 3,828,892 | A | 8/1974 | Winkler et al. | |
| 3,841,443 | A | 10/1974 | Booker, Jr. | |
| 3,851,735 | A | 12/1974 | Winkler et al. | |
| 3,895,692 | A | 7/1975 | Yeasting | |
| 3,898,611 | A | 8/1975 | Mandel | |
| 3,902,571 | A | 9/1975 | Iwasaka et al. | |
| 4,037,688 | A | 7/1977 | Winkler et al. | |
| 4,043,429 | A | 8/1977 | Hirasawa et al. | |
| RE29,543 | E * | 2/1978 | Glaser | 187/386 |
| 4,124,102 | A | 11/1978 | Doane et al. | |
| 4,128,143 | A | 12/1978 | Petterson et al. | |
| 4,162,719 | A | 7/1979 | Husson et al. | |
| 4,245,670 | A | 1/1981 | Bauer et al. | |
| 4,263,989 | A | 4/1981 | Zeindler et al. | |
| 4,266,632 | A | 5/1981 | Yoneda et al. | |
| 4,298,100 | A | 11/1981 | Suss et al. | |
| 4,305,479 | A | 12/1981 | Bittar et al. | |
| 4,323,142 | A | 4/1982 | Bittar | |
| 4,341,288 | A | 7/1982 | Bass | |
| 4,349,087 | A | 9/1982 | Bittar et al. | |
| 4,350,226 | A | 9/1982 | Sheehy et al. | |
| 4,352,410 | A | 10/1982 | Bittar et al. | |
| 4,352,411 | A | 10/1982 | Nowak et al. | |
| 4,352,412 | A | 10/1982 | Bittar et al. | |

(Continued)

FOREIGN PATENT DOCUMENTS

| | | |
|---|---|---|
| GB | 2 276 470 A | 9/1994 |

(Continued)

*Primary Examiner* — Anthony Salata
(74) *Attorney, Agent, or Firm* — Brinks Hofer Gilson & Lione

(57) ABSTRACT

A method of controlling an intelligent destination elevator control system streamlines the control of two or more destination elevators. Operations of a group of destination elevators are monitored to gain experience about how the population is served by the group of destination elevators that serves a building or a building zone. The analysis of measured and/or modeled data and conditions with data about traffic patterns and traffic characteristics enables the system to dynamically control the destination elevators. The system may enhance passengers' experience through efficiency and/or with an improved comfort level.

10 Claims, 8 Drawing Sheets

U.S. PATENT DOCUMENTS 4,355,705 A 10/1982 Schröder et al.
4,363,381 A 12/1982 Bittar
4,379,499 A 4/1983 Nowak
4,397,377 A 8/1983 Husson et al.
4,401,190 A * 8/1983 Bittar ..... 187/387
4,411,337 A 10/1983 Schroder et al.
4,431,085 A 2/1984 MacDonald
4,431,086 A 2/1984 Moser et al.
4,434,873 A 3/1984 Ohta et al.
4,448,286 A 5/1984 Kuzunuki et al.
4,458,787 A 7/1984 Uetani
4,463,834 A 8/1984 Polis et al.
4,473,134 A 9/1984 Uetani
4,492,288 A 1/1985 Schröder
4,499,973 A 2/1985 De Lorenzi et al.
4,511,017 A 4/1985 MacDonald
4,531,616 A 7/1985 Uetani et al.
4,568,909 A 2/1986 Whynacht
4,582,173 A 4/1986 Schröder
4,655,325 A 4/1987 Schröder et al.
4,669,579 A 6/1987 Ookubo
4,672,531 A 6/1987 Uetani
4,685,536 A 8/1987 Ichioka
4,691,808 A 9/1987 Nowak et al.
4,709,788 A 12/1987 Harada
4,711,324 A 12/1987 Schröder
4,718,520 A 1/1988 Schröder
4,719,996 A 1/1988 Tsuji
4,724,931 A 2/1988 Ichioka
4,735,294 A 4/1988 Schröder
4,760,896 A * 8/1988 Yamaguchi ..... 187/382
4,787,481 A 11/1988 Farrar et al.
4,836,336 A 6/1989 Schröder
4,838,385 A 6/1989 Ekholm
4,844,204 A 7/1989 Ovaska et al.
4,860,207 A 8/1989 Kubo
4,869,348 A 9/1989 Schröder
4,878,562 A 11/1989 Schröder
4,895,223 A 1/1990 Ekholm et al.
4,901,822 A 2/1990 Tsuji
4,915,197 A 4/1990 Schröder
4,926,976 A 5/1990 Schröder
4,930,603 A 6/1990 Brenner
4,939,634 A 7/1990 Schroder
4,947,965 A * 8/1990 Kuzunuki et al. ..... 187/387
4,958,707 A 9/1990 Yoneda et al.
4,972,926 A 11/1990 Tsuji et al.
4,979,594 A 12/1990 Begle et al.
4,982,817 A 1/1991 Tsuji
4,989,694 A 2/1991 Ueshima et al.
4,989,695 A 2/1991 Kubo
4,991,694 A 2/1991 Friedli
4,993,518 A 2/1991 van Straaten et al.
5,010,472 A 4/1991 Yoneda et al.
5,020,642 A 6/1991 Tsuji
5,031,728 A 7/1991 Amano
5,042,620 A 8/1991 Yoneda et al.
5,054,585 A 10/1991 Amano
5,056,628 A 10/1991 Aime
5,058,711 A 10/1991 Tsuji
5,065,846 A 11/1991 Schroder
5,086,883 A 2/1992 Schroder
5,092,431 A 3/1992 Schroder
5,142,107 A 8/1992 Yasuhiro
5,168,135 A 12/1992 Kubo et al.
5,183,981 A 2/1993 Thangavelu
5,192,836 A 3/1993 Schroder
5,202,540 A 4/1993 Auer et al.
5,229,559 A 7/1993 Siikonen et al.
5,235,143 A 8/1993 Bahjat et al.
5,239,141 A 8/1993 Tobita et al.
5,239,142 A 8/1993 Ekholm et al.
5,250,766 A 10/1993 Hikita et al.
5,252,789 A 10/1993 Sirag, Jr. et al.
5,252,790 A 10/1993 Aime
5,257,176 A 10/1993 Uetani
5,258,586 A 11/1993 Suzuki et al.
5,272,287 A 12/1993 Meguerdichian et al.
5,272,288 A 12/1993 Kameli
5,283,399 A 2/1994 Fujino et al.
5,285,028 A 2/1994 Umeda et al.
5,298,696 A 3/1994 Okataku et al.
5,300,739 A 4/1994 Bittar
5,306,878 A 4/1994 Kubo
5,307,903 A 5/1994 Morita et al.
5,317,114 A 5/1994 Pullela et al.
5,331,121 A 7/1994 Tsuji
5,334,807 A 8/1994 Kubo et al.
5,354,957 A 10/1994 Robertson
5,360,952 A 11/1994 Brajczewski et al.
5,383,535 A 1/1995 Ando
5,409,085 A 4/1995 Fujino et al.
5,459,665 A * 10/1995 Hikita et al. ..... 701/118
5,480,005 A 1/1996 Bittar
5,480,006 A 1/1996 Kameli et al.
5,503,249 A 4/1996 Virtamo et al.
5,612,519 A 3/1997 Chenais
5,616,894 A 4/1997 Nieminen et al.
5,616,896 A 4/1997 Kontturi et al.
5,663,538 A 9/1997 Sakita
5,679,932 A 10/1997 Kim
5,689,094 A 11/1997 Friedli et al.
5,714,725 A 2/1998 Thangavelu
5,750,946 A 5/1998 Thangavelu
5,767,460 A 6/1998 Thangavelu
5,767,461 A 6/1998 Nakagawa et al.
5,767,462 A 6/1998 Thangavelu
5,780,789 A 7/1998 Tsuji
5,785,153 A 7/1998 Powell et al.
5,786,550 A 7/1998 Thangavelu
5,786,551 A 7/1998 Thangavelu
5,789,715 A 8/1998 Kakko et al.
5,808,247 A * 9/1998 Thangavelu ..... 187/386
5,841,084 A 11/1998 Thangavelu
5,848,669 A 12/1998 Park
5,865,274 A 2/1999 Kiji et al.
5,884,729 A 3/1999 Park et al.
5,892,190 A 4/1999 Morita et al.
5,907,137 A 5/1999 Tyni et al.
5,932,852 A 8/1999 Tyni et al.
5,955,708 A 9/1999 Amano et al.
6,003,637 A 12/1999 Kim et al.
6,065,570 A 5/2000 Friedli et al.
6,145,631 A 11/2000 Hikita et al.
6,176,351 B1 1/2001 Ikeda et al.
6,237,721 B1 5/2001 Siikonen
6,273,217 B1 8/2001 Hikita
6,315,082 B2 11/2001 Hikita
6,321,877 B2 11/2001 Yamakawa
6,325,178 B2 * 12/2001 Hikita et al. ..... 187/382
6,328,134 B1 12/2001 Hikita
6,330,935 B1 12/2001 Systermans
6,345,697 B1 2/2002 Siikonen
6,378,662 B1 4/2002 Yamada
6,394,232 B1 5/2002 Iwata et al.
6,401,874 B2 6/2002 Siikonen
6,419,051 B2 7/2002 Mori et al.
6,446,761 B1 9/2002 Motoyama et al.
6,467,583 B1 10/2002 Koura et al.
6,533,075 B2 3/2003 Masuda
6,553,269 B1 4/2003 Hikita
6,601,678 B2 8/2003 Kostka et al.
6,619,436 B1 9/2003 Hikita
6,619,437 B2 9/2003 Hikita
6,644,442 B1 11/2003 Ylinen et al.
6,655,501 B2 12/2003 Kostka
6,708,801 B2 3/2004 Nakai
6,735,556 B2 5/2004 Copel
6,786,306 B2 9/2004 Tiner
6,793,044 B2 9/2004 Koehler et al.
6,896,105 B1 5/2005 Yamakawa
6,902,041 B2 6/2005 Eccleston
6,905,003 B2 6/2005 Hirade
6,913,117 B2 7/2005 Tyni et al.
6,945,365 B2 9/2005 Matela
6,978,863 B2 12/2005 Hikita
6,988,071 B1 1/2006 Gazdzinski

| | | | | |
|---|---|---|---|---|
| 6,991,068 | B2 | 1/2006 | Siikonen et al. | |
| 6,998,995 | B2 | 2/2006 | Nakajima | |
| 7,021,428 | B2 | 4/2006 | Han et al. | |
| 7,021,429 | B2 | 4/2006 | Hikita | |
| 7,032,716 | B2 | 4/2006 | Meyle et al. | |
| 7,036,635 | B2 | 5/2006 | Rintala et al. | |
| 7,083,027 | B2 | 8/2006 | Siikonen et al. | |
| 7,093,693 | B1 | 8/2006 | Gazdzinski | |
| 7,117,980 | B2 | 10/2006 | Wyss et al. | |
| 7,128,190 | B2 | 10/2006 | Kostka et al. | |
| 7,134,530 | B2 | 11/2006 | Motoyama et al. | |
| 2001/0000395 | A1 * | 4/2001 | Hikita et al. | 187/382 |
| 2001/0002635 | A1 | 6/2001 | Yamakawa | |
| 2001/0002636 | A1 | 6/2001 | Siikonen | |
| 2001/0010278 | A1 | 8/2001 | Hikita | |
| 2001/0032756 | A1 | 10/2001 | Mori et al. | |
| 2001/0035314 | A1 | 11/2001 | Yoshida et al. | |
| 2002/0023802 | A1 | 2/2002 | Ayano et al. | |
| 2002/0036122 | A1 | 3/2002 | Fayette et al. | |
| 2002/0112923 | A1 | 8/2002 | Nakai | |
| 2003/0000776 | A1 | 1/2003 | Kostka | |
| 2003/0006100 | A1 | 1/2003 | Masuda | |
| 2003/0051947 | A1 | 3/2003 | Friedli | |
| 2003/0070883 | A1 | 4/2003 | Foster et al. | |
| 2003/0085079 | A1 | 5/2003 | Koehler et al. | |
| 2003/0098208 | A1 | 5/2003 | Hikita | |
| 2003/0164267 | A1 | 9/2003 | Hikita | |
| 2004/0000453 | A1 | 1/2004 | Eccleston | |
| 2004/0129502 | A1 | 7/2004 | Hikita | |
| 2004/0154872 | A1 | 8/2004 | Hirade | |
| 2004/0163895 | A1 | 8/2004 | Kostka et al. | |
| 2004/0240627 | A1 | 12/2004 | Nakajima | |
| 2004/0262092 | A1 | 12/2004 | Wyss et al. | |
| 2005/0029054 | A1 | 2/2005 | Matela | |
| 2005/0077116 | A1 | 4/2005 | Urata | |
| 2005/0098391 | A1 | 5/2005 | Rintala et al. | |
| 2005/0109562 | A1 | 5/2005 | Siikonen et al. | |
| 2005/0126863 | A1 | 6/2005 | Hikita | |
| 2005/0155821 | A1 | 7/2005 | Marterer | |
| 2005/0189181 | A1 | 9/2005 | Meyle et al. | |
| 2005/0217946 | A1 | 10/2005 | Siikonen et al. | |
| 2005/0269164 | A1 | 12/2005 | Tyni et al. | |
| 2005/0279584 | A1 | 12/2005 | Reuter et al. | |
| 2006/0032711 | A1 | 2/2006 | Marchesi | |
| 2006/0042884 | A1 | 3/2006 | Abe et al. | |
| 2006/0065491 | A1 | 3/2006 | Zaharia et al. | |
| 2006/0157305 | A1 | 7/2006 | DePlazes et al. | |
| 2006/0175146 | A1 | 8/2006 | Hikita | |
| 2006/0180406 | A1 | 8/2006 | Gremaud et al. | |
| 2006/0213727 | A1 | 9/2006 | Hikita | |
| 2006/0213728 | A1 | 9/2006 | Yoshikawa et al. | |
| 2006/0242200 | A1 | 10/2006 | Horowitz et al. | |
| 2006/0243536 | A1 | 11/2006 | Tyni et al. | |
| 2006/0249335 | A1 | 11/2006 | Yoshikawa et al. | |
| 2006/0271589 | A1 | 11/2006 | Horowitz et al. | |
| 2006/0271623 | A1 | 11/2006 | Horowitz et al. | |
| 2006/0289243 | A1 | 12/2006 | Hikita et al. | |
| 2007/0017753 | A1 | 1/2007 | Ylinen et al. | |
| 2007/0039785 | A1 | 2/2007 | Smith et al. | |
| 2007/0080027 | A1 | 4/2007 | De Jong et al. | |

FOREIGN PATENT DOCUMENTS

| | | | |
|---|---|---|---|
| WO | WO 2004/031062 | A | 4/2004 |
| WO | WO 2007/147927 | A | 12/2007 |

* cited by examiner

Round Trip Time (RTT) matrix for round trips over full building height

| Number of add. stops | Sum of all DDFT's | Total of all passengers transported during round trip | | | | | | | | | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| | 57.6 | 59.6 | 61.6 | 63.6 | 65.6 | 67.6 | 69.6 | 71.6 | 73.6 | 75.6 | 77.6 | 79.6 | 81.6 | 83.6 | 85.6 | 87.6 | 89.6 |
| 1 | 65.6 | 67.6 | 69.6 | 71.6 | 73.6 | 75.6 | 77.6 | 79.6 | 81.6 | 83.6 | 85.6 | 87.6 | 89.6 | 91.6 | 93.6 | 95.6 | 97.6 |
| 2 | 73.6 | 75.6 | 77.6 | 79.6 | 81.6 | 83.6 | 85.6 | 87.6 | 89.6 | 91.6 | 93.6 | 95.6 | 97.6 | 99.6 | 101.6 | 103.6 | 105.6 |
| 3 | 81.6 | 83.6 | 85.6 | 87.6 | 89.6 | 91.6 | 93.6 | 95.6 | 97.6 | 99.6 | 101.6 | 103.6 | 105.6 | 107.6 | 109.6 | 111.6 | 113.6 |
| 4 | 89.6 | 91.6 | 93.6 | 95.6 | 97.6 | 99.6 | 101.6 | 103.6 | 105.6 | 107.6 | 109.6 | 111.6 | 113.6 | 115.6 | 117.6 | 119.6 | 121.6 |
| 5 | 97.6 | 99.6 | 101.6 | 103.6 | 105.6 | 107.6 | 109.6 | 111.6 | 113.6 | 115.6 | 117.6 | 119.6 | 121.6 | 123.6 | 125.6 | 127.6 | 129.6 |
| 6 | 105.6 | 107.6 | 109.6 | 111.6 | 113.6 | 115.6 | 117.6 | 119.6 | 121.6 | 123.6 | 125.6 | 127.6 | 129.6 | 131.6 | 133.6 | 135.6 | 137.6 |
| 7 | 113.6 | 115.6 | 117.6 | 119.6 | 121.6 | 123.6 | 125.6 | 127.6 | 129.6 | 131.6 | 133.6 | 135.6 | 137.6 | 139.6 | 141.6 | 143.6 | 145.6 |
| 8 | 121.6 | 123.6 | 125.6 | 127.6 | 129.6 | 131.6 | 133.6 | 135.6 | 137.6 | 139.6 | 141.6 | 143.6 | 145.6 | 147.6 | 149.6 | 151.6 | 153.6 |
| 9 | 129.6 | 131.6 | 133.6 | 135.6 | 137.6 | 139.6 | 141.6 | 143.6 | 145.6 | 147.6 | 149.6 | 151.6 | 153.6 | 155.6 | 157.6 | 159.6 | 161.6 |
| 10 | 137.6 | 139.6 | 141.6 | 143.6 | 145.6 | 147.6 | 149.6 | 151.6 | 153.6 | 155.6 | 157.6 | 159.6 | 161.6 | 163.6 | 165.6 | 167.6 | 169.6 |
| 11 | 145.6 | 147.6 | 149.6 | 151.6 | 153.6 | 155.6 | 157.6 | 159.6 | 161.6 | 163.6 | 165.6 | 167.6 | 169.6 | 171.6 | 173.6 | 175.6 | 177.6 |
| 12 | 153.6 | 155.6 | 157.6 | 159.6 | 161.6 | 163.6 | 165.6 | 167.6 | 169.6 | 171.6 | 173.6 | 175.6 | 177.6 | 179.6 | 181.6 | 183.6 | 185.6 |
| | 57.6 | 57.6 seconds is the total of the DDFT's of non-stop trips from floor zero to floor 13 and back to floor zero. | | | | | | | | | | | | | | | |

Figure 2

| Number of upper floors served | Floor designation highest floor | Total zone population | Total travel in meters | Contract speed in m/sec. | Average car load in persons | Number of "selected floors" | Number of "probable stops" | Average RTT Low & High trips | Average Travel Time in the car | Average time for group to serve all floors once | % of population distributed into building by 4 elevators in 5 min. | Average Time To Destination in seconds (= AWT + ATTC) | Average departure INTERVAL from floor zero | Cycle INTERVAL: INTERVAL for AWT calculation | Theoretical minimum Average Waiting Time (AWT) in seconds |
|---|---|---|---|---|---|---|---|---|---|---|---|---|---|---|---|
| Nr flrs served | Top floor | Pop. | Trav. | Contr. speed | Car load | Sel. floors | Prob. stops | Av. RTT L & H | ATTC | Cycle RTT | DC5 4-cars | ATTD ATTD | Dep. INT | Cycle INT | AWT |
| 12 | 12 | 900 | 48 | 2.5 | 14.0 | 12 | 8.45 | 140.9 | 55.0 | 140.9 | 13.2 | 72.6 | 35.2 | 35.2 | 17.6 |
| 12 | 12 | 900 | 48 | 2.5 | 13.4 | 11 | 7.93 | 135.3 | 52.6 | 147.6 | 13.2 | 71.1 | 33.8 | 36.9 | 18.5 |
| 12 | 12 | 900 | 48 | 2.5 | 12.8 | 10 | 7.40 | 129.2 | 50.2 | 155.1 | 13.2 | 69.6 | 32.3 | 38.8 | 19.4 |
| 12 | 12 | 900 | 48 | 2.5 | 12.0 | 9 | 6.81 | 121.6 | 47.5 | 162.2 | 13.2 | 67.8 | 30.4 | 40.5 | 20.3 |
| 12 | 12 | 900 | 48 | 2.5 | 11.2 | 8 | 6.21 | 113.4 | 44.7 | 170.2 | 13.2 | 66.0 | 28.4 | 42.5 | 21.3 |
| 12 | 12 | 900 | 48 | 2.5 | 10.7 | 7 | 5.65 | 108.2 | 42.2 | 185.4 | 13.2 | 65.4 | 27.0 | 46.4 | 23.2 |
| 12 | 12 | 900 | 48 | 2.5 | 9.3 | 6 a | 4.90 | 94.0 | 38.6 | 188.1 | 13.2 | 62.1 | 23.5 | 47.0 | 23.5 |
| 12 | 12 | 900 | 48 | 2.5 | 9.3 | 6 b | 4.80 | 101.5 | 42.3 | 203.0 | 12.2 | 67.7 | 25.4 | 50.8 | 25.4 |
| 12 | 12 | 900 | 48 | 2.5 | 9.0 | 5 | 4.33 | 90.9 | 36.1 | 218.2 | 13.2 | 63.4 | 22.7 | 54.6 | 27.3 |
| 12 | 12 | 900 | 48 | 2.5 | 7.6 | 4 | 3.55 | 76.9 | 32.4 | 230.7 | 13.2 | 61.2 | 19.2 | 57.7 | 28.8 |

Figure 3

| Trip number | 1 | 2 | 3 | 4 | 5 | 6 | 7 | 8 | 9 | 10 | 11 | 12 |
|---|---|---|---|---|---|---|---|---|---|---|---|---|
| | **Number of "selected floors" = 5** | | | | | | | | | | | |
| Floors served | | | | | | | | | | | | |
| 12 | | | X | | X | | | X | | X | | X |
| 11 | | | X | | X | | X | | | X | | X |
| 10 | | X | | | X | | X | | | X | | X |
| 9 | | X | | | X | | X | | X | | | X |
| 8 | | X | | X | | | X | | X | | | X |
| 7 | | X | | X | | | X | | X | | X | |
| 6 | | X | | X | | X | | | X | | X | |
| 5 | X | | | X | | X | | | X | | X | |
| 4 | X | | | X | | X | | X | | | X | |
| 3 | X | | X | | | X | | X | | | X | |
| 2 | X | | X | | | X | | X | | X | | |
| 1 | X | | X | | X | | | X | | X | | |
| 0 | X | X | X | X | X | X | X | X | X | X | X | X |

X floor served  floor not served

Figure 7

METHOD OF CONTROLLING INTELLIGENT DESTINATION ELEVATORS WITH SELECTED OPERATION MODES

PRIORITY CLAIM

This application claims the benefit of priority from U.S. Provisional Application No. 60/957,032, filed Aug. 21, 2007, which is incorporated by reference.

BACKGROUND OF THE INVENTION

1. Technical Field

This application relates to elevator control systems, and more particularly, to intelligent destination elevator control systems.

2. Related Art

Buildings are served by elevators. Traditionally, elevators may include "collective selective" controls, such as up and down buttons at the elevator lobbies and individual floor buttons in the elevator cars. Movement of these elevators may be directed by the random destinations of passengers which may result in an inefficient distribution of the passengers into the building.

Some buildings use elevator systems that require passengers to enter their floor destinations on panels in the elevator lobbies. These systems assign passengers to specific cars based on their destinations. Distribution of the passengers in these systems are based on the passenger selected destinations. These systems may not rely on options that may aid in the distribution of the passengers.

SUMMARY

An intelligent destination elevator control system streamlines the efficiency and control of destination elevators. The system monitors a building's population and predicts elevator traffic conditions. The system may monitor attributes of the destination elevators. Based on the monitored data, the system may generate a data structure that renders time-tables and target elevator service quality parameters that may control the destination elevators. A time-table and target elevator service quality parameters may be selected to control destination elevators according to one or more customer selectable mode of operation parameters. The data structure may be processed to control UP and/or DOWN transportation capacities of the destination elevators while satisfying the one or more customer selectable mode of operation parameters.

Some intelligent destination elevator control systems may control when elevator cars of a group service the floors of a building. Control of the elevator cars may be flexible to allow the system to increase or decrease transportation capacities of the elevator cars in accordance with anticipated traffic conditions.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 2 is an exemplary representation of roundtrip data that may accessed by an intelligent destination elevator control system.

FIG. 3 an exemplary representation of comparative data that may be accessed an intelligent destination elevator control system.

FIG. 7 is An exemplary graphical representation of a direct trip pattern.

DETAILED DESCRIPTION OF THE PREFERRED EMBODIMENTS

An intelligent destination elevator control system streamlines the control of two or more destination elevators. The system monitors operations of a group of destination elevators to gain experience about how the population served by the group of destination elevators makes use of the services provided by these elevators. The analysis of measured and/or modeled data and conditions with data about traffic patterns and traffic characteristics enables the system to dynamically control the destination elevators. The system may enhance passengers' experiences through efficiency and/or with an improved comfort level.

The system may generate and/or evaluate building or user data and traffic density data to select a mode of operation for the destination elevators that satisfies one or more service quality requirements. Based on the selected mode of operation, additional service quality parameters that satisfy the service quality requirements may be configured. By monitoring traffic density and operation of the group of elevators, the system may dynamically adjust the destination elevator service quality parameters to satisfy the selected service quality requirements. Adjustments may be made to the destination elevator service quality parameters before traffic densities change, and may appear to be instantaneous (e.g., real-time), about real-time, or during a time period that will occur in the future (e.g., batch processing).

Figure 1:
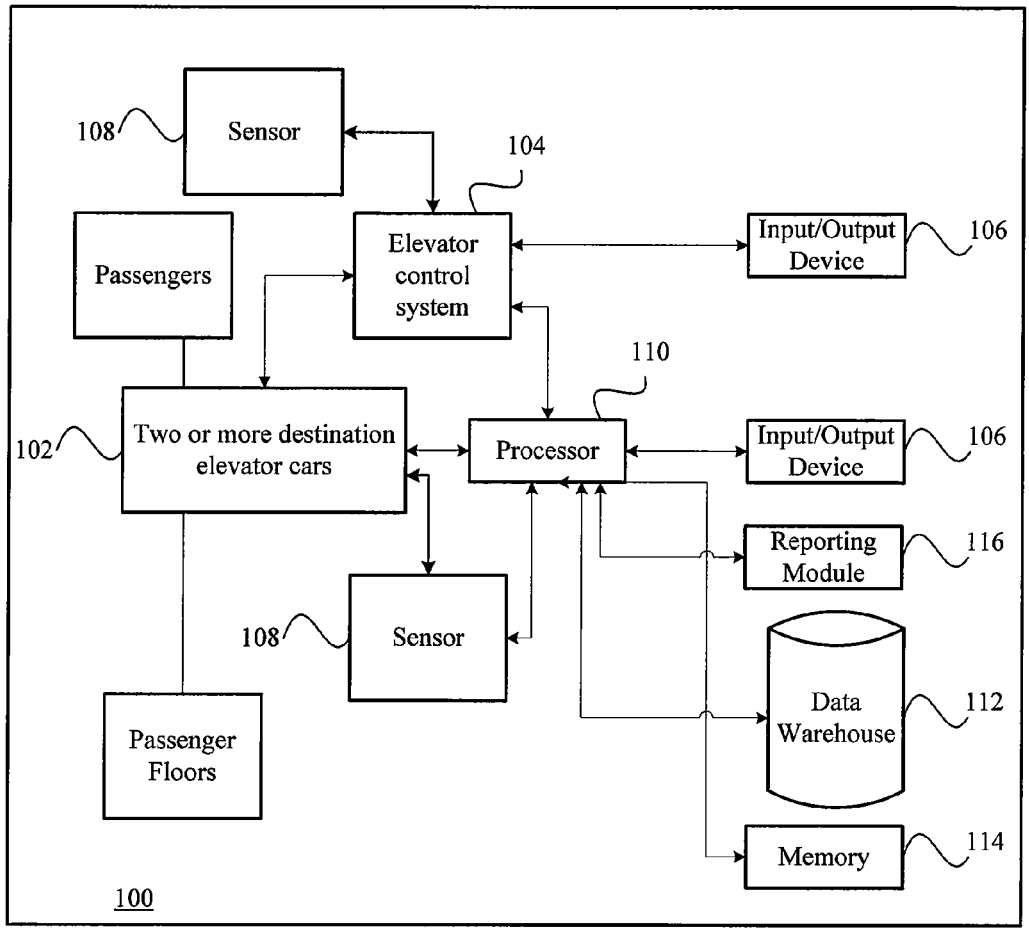
FIG. 1 is an exemplary system of an intelligent destination elevator control system.

The intelligent destination elevator control system 100 of FIG. 1 may include a group of devices or structures that may convey persons or things to different levels within a building 102. Movement of the elevator cars 102 may be controlled by an elevator control system 104 that may comprise a local area and/or wide area network. The local area network may comprise a local or remote computer or controller that may execute various computer applications to control how quickly an elevator car 102 may move between levels within the building. In some systems, the elevator control system 104 may comprise a drive train (e.g., a rope/chain system driven by a motor and gears). In some systems, the elevator control system 104 may include counterweights which may control movement of an elevator car 102. The elevator car 102 and/or the counterweights may travel within a guide rail assembly. Brakes may be used to hold the elevator car 102 in place when it has reached the desired destination. A safety brake may prevent the elevator car 102 from falling in the event of a failure. Other elevator control systems 104 may use alternative systems (e.g., hydraulic or pneumatic systems) for raising and/or lowering an elevator car 102.

Movement of an elevator car 102 between floors or levels within the building may be associated with controlling ancillary functions such as attributes related to the elevator car 102. In some systems, these attributes may include the closing and opening of the elevator car doors, detecting and/or measuring a load in the elevator 102, controlling motor functions, locking the doors, controlling brake functions, controlling the flight of the elevator car 102, and/or other attributes. Control of the flight of the elevator 102 may include controlling acceleration, deceleration, and/or jerk rates of the elevator 102. The elevator control system 104 may further comprise one or more optical or electronic sensors that may detect and/or measure some or each of the attributes. The sensors may monitor one or more levels within the building.

A group of elevators 102 may comprise destination elevators cars. "Collective Selective Controls" may be absent from elevator lobbies and destination elevators cars. Instead, input/output device(s) 106 may be present in an elevator lobby. Passengers may use the input portion of the device 106 to select a floor destination. The system may evaluate a selected destination, a traffic density, a traffic density pattern, an operational status and/or an operation mode of two or more (e.g., a group) elevators 102. Based on an automated analysis a processor or controller may assign passengers to an elevator car that will service their desired floor(s). The output portion of the device 106 may indicate to the passenger the destination elevator car to which it is assigned.

The input/output device(s) 106 may be separate devices or may be a unitary device. The input device 106 may receive a passenger's destination through a speech input, a touch input, and/or an interface that receives an electronic signal transmitted through a wireless or wired communication medium. The output device 106 may be an audio device that converts an electrical signal to an aural signal which is presented to the passenger. In other systems, the output device 106 may be a visual device that provides a visual indication of the passenger's assigned elevator car. In yet other systems, the output device may comprise a combined audio/video device.

A sensor or network/array of sensors 108 may be positioned on or within an elevator car 102, and/or within an elevator shaft in which an elevator car travels. The sensor(s) 108 may be a single or multifunctional controllable sensor capable of detecting, measuring, and/or modeling in real-time, near real-time, or delayed time elevator attributes. The elevator attributes may include an elevator car travel time (e.g., flight time) between floors; an amount of time for the elevator doors to open, remain open, close, and/or lock; the speed at which the elevator doors open and/or close, and/or the period of time an elevator car waits at a particular floor. In some systems, the sensor(s) 108 may detect, measure, and/or model a moving speed of an elevator car 102, and/or rates of acceleration, deceleration, and jerk. Data detected or measured by the sensor(s) 108 may occur through continuous periods, or may occur at intervals, such as a seasonal time period, months, days, hours, and/or a predetermined range of time (e.g., about every 5 minutes or about every 10 minutes).

In some systems, the detected, measured, and/or modeled data may be transmitted to a processing and/or storage device, such as a processor 110, a data warehouse 112, a memory 114, and/or other processing or storage devices. In some systems the processor 110 may comprise a controller. The processor 110 may be part of a local area and/or wide area network and may be linked to the data warehouse 112 (e.g., one or more databases that may be distributed and accessible to one or more computers and which may retain data structures from one or many sources in a common or variety of formats) and the memory 114, and in some alternative systems, linked to external computers, databases, processors, and/or storage devices. The transmission of the detected, measured, and/or modeled data may pass through a wireless or wired communication medium. In some systems, the transmission of this data may occur automatically (e.g., pushed). In these systems, the data may be transmitted upon an event, a detection, measurement, and/or completion of the modeling. Alternatively, the data may be transmitted to the processing and/or storage device at periodic intervals. In other systems, the data may be transmitted in response to a request from a higher level device to transmit the data (e.g., pull technology).

Some or all of the detected, measured, and/or modeled data may be retained in the data warehouse 112 and/or memory 114 and may be combined and/or recombined by the processor 110 to generate subsidiary data representing attributes of the group of elevators and/or a building's traffic flows. In some systems, the combination and/or recombination of data may comprise the processor 110 applying one or more expressions to one or multiple elements of the received and/or retained data. The processing of the received and/or retained data may render data that represents the operation or movement of the elevator cars and/or passengers. Alternatively, the processor 110 may perform a statistical analysis of some or all of the received or retained data to generate probabilistic estimates/analysis of the operation or movement of the elevator cars and/or passengers throughout the building. In yet other systems, the data may be combined and/or recombined in other manners to generate the subsidiary data. Some or all of the data may be retained in one or more data structures in the data warehouse 112 and/or the memory 114 for future use or analysis.

Based on the data, and one or more customer selectable mode of operation parameters, the processor 110 may access one or more of the data structures to determine a mode of operation for the destination elevators 102. Target service quality parameters corresponding to the selected operation mode may be used to control the destination elevators 102. Through continuous or periodic monitoring of data and the programmed target service quality parameters, the processor 110 may determine if an operation mode of the destination elevators 102 should be changed. Alternatively, through the continuous or periodic monitoring of the data and the programmed target service quality parameters, the processor 110 may determine that an adjustment to an operational parameter of a destination elevator is necessary. In these situations, the system may modify one or more operational parameters of one or more of the destination elevators as required.

The databases that form the data warehouse 112 (e.g., Structured Query Language databases or SQL DBs, databases that comprise one or more flat files, such as 2-dimensional arrays, multi-dimensional arrays, etc. retained in a memory) may include data structures that contain fields together with a set of operations that facilitate searching, sorting, recombining, and other functions. While the data warehouse 112 may be distributed across remote locations, accessed by several computers, and contain information from multiple sources in a variety of formats, some data warehouses 112 may be local to the intelligent destination elevator control system 100 or controller. For longer term storage or data analysis, data may be retained in archival databases(s). Some systems include a backup that allows the data warehouse 112 to be restored to previous state. The system may restore the data warehouse 112 when a software or hardware error has rendered some or the entire data warehouse 112 unusable. When some errors occur to some or all of the databases, the backup data warehouse may automatically step in and assume the processes and functionality as a primary data warehouse 112.

The databases may comprise hierarchical databases that retain searchable indices within the database that reference distinct portions of the database and/or data locations within ancillary storage devices or remote databases. The databases and storage devices may be accessible through a database management system which may include data about how the databases are organized, how data within a database and/or across multiple databases are related, and/or how to maintain the databases. In some systems, the databases may comprise network databases that retain data with links to other records within a similar or different database. Data within a network database may be accessed without accessing some of the higher level information that corresponds to the accessed data. In yet other systems, the databases may comprise relational databases that retain data in a tabular format which may be accessed through searchable indices.

A roundtrip computer database may be part of the data warehouse 112. The roundtrip computer database may comprise data representing movement of an elevator car 102 from the time the elevator car 102 leaves a reference floor (e.g., the main floor) of a building until the time the elevator car 102 returns to the reference floor. In some systems, the roundtrip computer database may include the measured number of stops an elevator car makes during an UP trip, the number of passengers in an elevator car during an UP trip, the building level (e.g., floor) where an elevator reverses direction and starts traveling in a downward direction, the number of stops during a DOWN trip, and the number of passengers in an elevator car during a DOWN trip. In some systems, the number of passengers in an elevator car during an UP or DOWN trip may be measured by a sensor that senses a number of passengers in an elevator car (e.g., an elevator car load). Based on the load in the elevator car, the system may calculate the number or average number of persons in the elevator car. In other systems, an optical sensor may detect when passengers cross the threshold of the elevator car. In yet other systems, other sensors based on the interpretation of video, infrared data, and/or floor pressure patterns may be used to detect the number of passengers in the elevator car. An evaluation of this data may be used to determine how many passengers enter, leave, and are in the elevator car at any time.

FIG. 2 is an exemplary representation of data that may be accessed from the roundtrip computer database and used in establishing a roundtrip travel time-table for a destination elevator. In FIG. 2, a roundtrip data structure shows how the roundtrip time of a destination elevator may be affected by the number of UP or DOWN stops a destination elevator makes, and the number of passengers transported during a roundtrip.

The data structure of FIG. 2 illustrates exemplary data for a destination elevator that serves 13 upper floors (e.g., 13 floors above the main lobby) that are spaced approximately 4 meters apart, and where the destination elevator travels at a speed of approximately 2.5 m/s. The data may vary with a building's configuration, the elevator car's 102 design, and/or the reversal floor. As shown in FIG. 2, the value in the top left corner may represent the time for an empty destination elevator to travel non-stop from a reference floor (e.g., floor zero) to a reversal floor and return non-stop to the reference floor. In FIG. 2, the reversal floor is the top floor of the building (e.g., floor 13), and the time period for this roundtrip is about 57.6 seconds. When the reversal floor is on a floor lower than the top floor, the time for the empty non-stop roundtrip would replace the about 57.6 second time period shown in FIG. 2. Although the data structure of FIG. 2 only shows the affects of 12 additional stops and the transportation of up to 16 passengers, the data structure may be expanded to account for the maximums for each trip (e.g., stopping at each floor on an UP and DOWN trip and/or transporting a maximum number of passengers permitted in the elevator car at one time). While the data of FIG. 2 is shown in a table format, the system need not generate this table, and/or include all of the information shown in FIG. 2. In some systems, some, all, or more data may be accessed from the data warehouse and used by other elements or processes of the system to control a destination elevator.

During a roundtrip of a destination elevator, each additional stop and each additional passenger transported during the roundtrip increases the total roundtrip travel time of the elevator car. Sensors may detect, measure, and/or monitor the amount of time that the roundtrip time is increased for each additional stop and the amount of time for each additional passenger to enter or leave the destination elevator. On the basis of predicted traffic conditions and/or one or more customer selectable mode of operation parameters, data may be accessed from the roundtrip computer database and used to establish a roundtrip time-table for a destination elevator.

Through the combination and/or recombination of data retained in the roundtrip computer database, subsidiary data representing the movement of the elevator cars, their loads, destinations, and passengers may be determined. Recombination of this data may be used to determine an UP and/or DOWN distribution/transportation capacity of a group during a predetermined time period (e.g., a percentage of a buildings population that may be distributed/transported by a group of elevators during the predetermined time period). In some systems, the data retained in the roundtrip computer database may be used to calculate the time interval that passes between two elevator cars leaving an elevator lobby (e.g., departure interval), an average amount of time that a passenger has to wait before its assigned elevator car departs for its destination (e.g. AWT), and/or an average amount of time a passenger spends in an elevator traveling to its destination (e.g. ATTD).

Data representing each service call of an elevator may be stored in a service calls computer database retained within the data warehouse 112. The service data retained in the service calls computer database may comprise the time of a service call (e.g., a request for an elevator to transport a passenger to another level of a building), the floor from which the service call is placed, the requested destination, the assigned elevator car, and/or the number of repeat calls from the same floor to the same destination after the first call and before the assigned elevator car departs.

The traffic density patterns of each floor within a building as well as the entire building may be retained in a traffic density pattern computer database. The data within the traffic density pattern computer database may track over time how many persons enter or exit a specific floor. The building population may be determined by tracking the total number of persons entering or exiting all of the floors within the building.

The system may retain within a systems operation computer database data which may reflect whether the elevator control system 104 and/or subsystems are functioning correctly. In some systems, monitoring/sensing of the elevator cars and/or elevator control system 104 may provide data such as, the time the doors of an elevator car start to close, the time the elevator cars doors are fully closed, and/or the time the elevator car doors are locked. Other sensed system operation data may include the time the elevator car starts to accelerate, the maximum speed reached during each trip, the time the car reaches its maximum speed, and/or the time the elevator car starts deceleration. Yet other sensed system operation data may include the time the elevator car doors start to open, the time the elevator car floor is level with the destination floor, and/or the time the elevator car doors are fully open.

Programmed operational ranges, as set by building management or other personnel, for sensed system operation data may also be retained within the systems operation computer database. When the system determines, through a comparison or other evaluation techniques, that one or more of the sensed times are outside of the selected operational range, the system may provide a feedback signal and/or alert message through a tangible or physical link to a reporting system or maintenance personnel. The alert message may indicate a potential problem with the elevator system, and may identify the device that is out of its operational range. When it is determined that the elevator control system 104 and/or subsystems are operating outside of the permissible ranges, the intelligent destination elevator control system 100 may take corrective action. Corrective action may include automatically adjusting a configurable elevator systems operation parameter. Alternatively, correction action may include removing an elevator car from service and/or generating and/or transmitting a service request to maintenance personnel.

Additional computer databases may retain data received from external sources. Data from the external sources may be received through wired or wireless networks. In some systems, the wireless networks may include satellite systems, signals transmitted through cellular networks, or other wireless systems. The external data may include information regarding weather conditions, disruptions of public transportation systems, vehicular traffic conditions, roadway or highway construction notices, emergency notices, and/or power failures. One or more of these situations/conditions may affect the arrival or departure rate of persons within the building and therefore may affect the transportation density within a building and/or the use of the group of elevators 102.

A performance computer database may be retained in the data warehouse 112. The performance computer database may comprise one or more data structures of data collected from some or all of the other computer databases retained in the data warehouse 112. The performance data structures may identify destination elevator systems operation parameters and available target service quality parameters for a destination elevators for the one or more customer selectable mode of operation parameters. In some systems, a performance data structure may include simulated data for a "collective selective" elevator. This information may be used by a reporting system to provide a comparison data of the intelligent destination elevator system to a "collective selective" system. Although the computer databases within the data warehouse 112 have been described individually, in some systems, some or all of this data may be retained in one or more multidimensional databases.

A reporting module 116 may provide information regarding operation of the intelligent destination elevator control system 100 and/or the group of elevators 102. The reporting module may be in communication with the processor 110 and may receive input through a system input/output device 106. The reporting module 116 may provide information to tenants of a building, to building managers, security personnel, and/or others individuals/entities that have been configured to receive reporting data. Reporting data may be provide on a display screen or transmitted through a communication medium to the selected recipients. In some systems, reporting data may be provided through electronic mail, to a mobile telephone, to a pager, to a landline telephone, and/or other computers and/or storage devices.

FIG. 3 is an exemplary representation of performance data that may be accessed from a performance computer database and/or other computer databases retained in the data warehouse. The data shown in FIG. 3 may comprise elevator car and/or building population data that was detected, measured, and/or modeled and which may be used to disclose the modes of car operations based on one or more customer selectable mode of operation parameters. In some instances, the data may be the result of the combination or recombination of other detected, measured, and/or modeled data retained in one or more of the data warehouse's databases.

The data shown in FIG. 3 is an exemplary portion of a performance data structure comprising data that may be accessed from the data warehouse. The exemplary data of FIG. 3 is for a group of 4 destination elevators and discloses possible modes of operation for an anticipated UP distribution capacity for a 5 minute period (DC5) of 13.2%. As shown in FIG. 3, for this UP distribution capacity, 10 different modes of operation for controlling the group of destination elevators may be available. Based on one or more customer selectable mode of operation parameters, the intelligent destination elevator control system 100 may select the mode of operation for the destination elevators. In some systems, the one or more customer selectable mode of operation parameters may be any of the destination elevator service quality parameters. For instance, in some systems, a customer (e.g., a building manager, security personnel, user, and/or other personnel) may determine that a mode of operation should be selected using a maximum number of permitted destinations during an UP trip as a customer selectable mode of operation parameter. In other systems, a customer may determine that a mode of operation should be selected using the shortest average waiting time as a customer selectable mode of operation parameter. In yet other systems, a customer may determine that a mode of operation should be selected using an average waiting time that does not exceed a predetermined time period. In yet other systems, a customer may determine that a mode of operation should be selected using the shortest average time to a destination as a customer selectable mode of operation parameter. Identifying the mode of car operation enables the intelligent elevator system to determine target service quality parameters for each roundtrip of a destination elevator and for the group of destination elevators.

As shown in FIG. 3, if a customer selectable mode of operation parameter was an average car load of about 10 passengers, the system may establish a time-table for the next departing destination elevator car to have an average roundtrip time (Ave RTT) of about 108 seconds, an average waiting time (AWT) of about 23 seconds, and an elevator car departure interval (Dep INT) of about 27 seconds. Additionally, selecting this mode of operation would imply that the system would accept a maximum number of UP destinations for the next departing roundtrip to be about 5 or about 6. The performance data structure also identifies other target service quality parameters (e.g., the average travel time in a car (ATTC), an average travel time to a destination (ATTD), an average time for all of the elevator cars to serve all of the floors once (Cycle RTT), an average reversal floor level, and/or other target service quality parameters), building information (e.g., the number of floors in the building, the top floor in the building, distance between floors), and/or elevator information (e.g., a maximum speed of the elevator car, acceleration/deceleration rate, etc.).

Based on this selected mode of operation, the system may predict when this elevator car will return to the main lobby. When an additional stop is requested during the roundtrip of this elevator, or the expected return time to the main lobby is delayed (e.g. a passenger held the door open too long) or accelerated (e.g., more passengers exited the elevator car on a certain floor), the system may review the time-table and update the control of the elevator car or the mode of operation. For example, if on departure the car load exceeds 11 passengers, the system could determine that the actual traffic density is higher than the anticipated traffic density. In this instance, the system may alter the target quality service parameters for a next departing car (e.g., reduce the maximum number of destinations) which may reduce the RTT of the next departing car and increase the distribution of the arriving passengers into the building. In some systems, the system may try to alter target service quality parameters so as to equalize the roundtrip travel time (RTT) of all elevators in a group and maintain a consistent departure interval between the elevators.

FIG. 3 is only a portion of a performance data structure. This data structure shows 10 different modes of car operations for servicing a 12 floor building that satisfies one anticipated UP traveling distribution capacity. Each mode of car operation delivers the anticipated UP distribution capacity (e.g., a first customer selectable mode of operation parameter), but a mode of operation may be selected based on one or more other customer selectable mode of operation parameters which provide other improved service qualities and/or comfort levels to the passengers. Performance data structures may be created for other traffic conditions that disclose the modes of car operations based on any service quality parameter than may be detected, measured, or modeled. For instance, a performance data structure may be created that comprises similar information based on a different anticipated UP traveling distribution capacity (e.g., DC4, DC10). Alternatively, a performance data structure may be created that comprises information based on DOWN traveling traffic, such as an anticipated DOWN traffic density (e.g., TC4, TC5, TC10, etc.). In yet other alternatives, a performance data structure may include the information shown in FIG. 3 but that is expanded to also include service quality parameters based on DOWN traveling traffic (such as a number of allowed DOWN stops and/or passengers, adjustments to RTTs, AWTs, ATTDs, Cycle RTTs, and/or Departure Intervals based on anticipated DOWN stops) and/or other service quality parameters. Other performance data structures may be created, such as for emergency situations when traffic is heavy (e.g., evacuation of a building).

Figure 4:
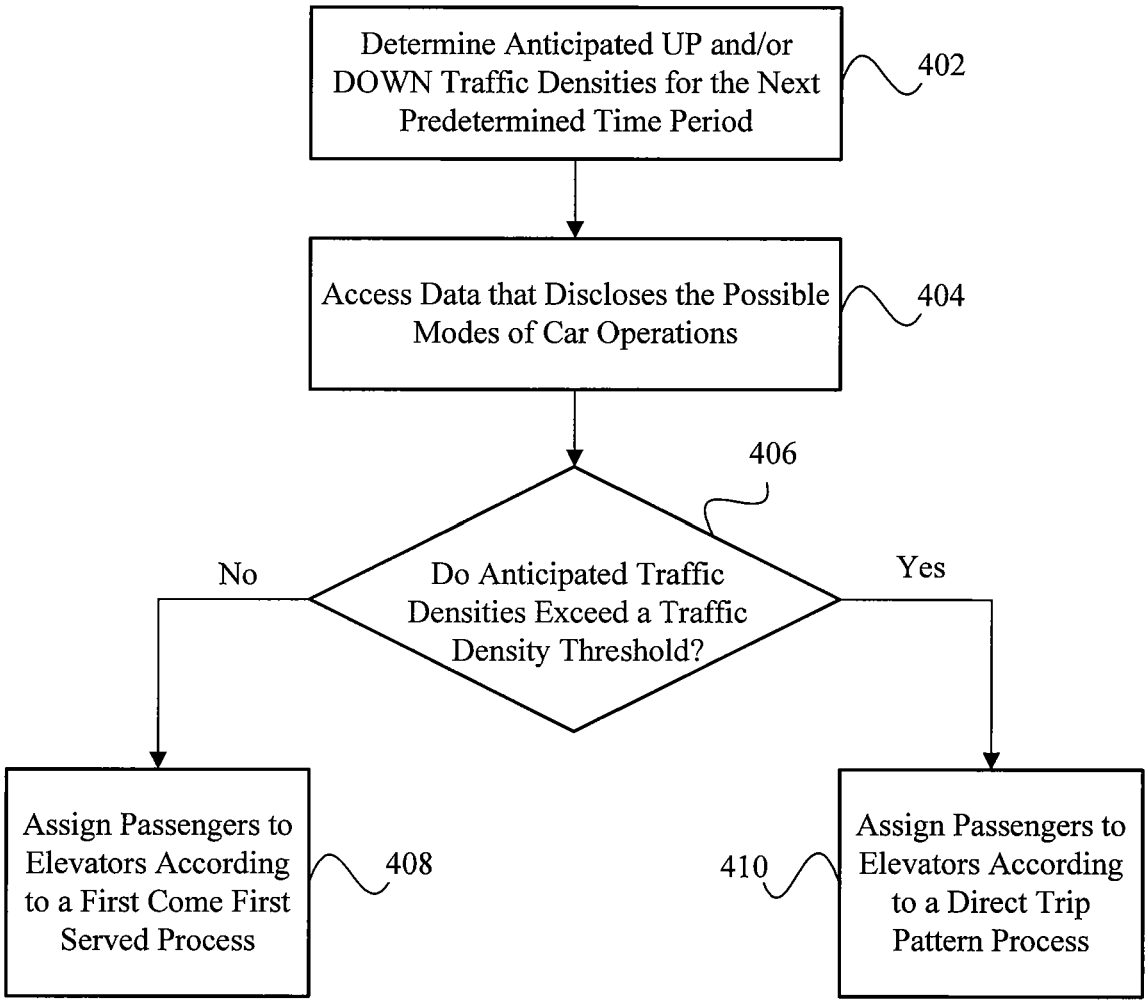
FIG. 4 is an exemplary process that controls a group of destination elevators.

FIG. 4 is an exemplary method of using an intelligent destination elevator control system to control a group of destination elevators. At act 402 the process determines an anticipated UP and/or DOWN traffic density for a next predetermined time period. The predetermined time period may be a seasonal period, month, day, week, hour, minutes, or other predetermined period of time. Because the process monitors the use of the elevators and the number of passengers entering and exiting each elevator car throughout the day, the process has the ability to learn the population and traffic density patterns for any time period in the building or on an individual floor. This population and/or traffic density data may be retained within the intelligent destination elevator control system's data warehouse, such as in the traffic density pattern computer database or another computer database. In some processes, anticipated traffic densities may be determined for time periods of about 5 minutes, about 10 minutes, or other time periods.

At act 404, the process accesses data retained in the data warehouse to determine the possible modes of car operations that will satisfy the anticipated traffic density. At act 406, the process determines whether the anticipated traffic density exceeds a traffic density threshold. In some processes, the traffic density threshold may be based on an anticipated UP traffic density, an anticipated DOWN traffic density, or a combined anticipated UP and anticipated DOWN traffic density. The traffic density threshold may be a customer selectable mode of operation parameter. In some processes, this threshold may be selected so that when the threshold is not exceeded the group of destination elevators are operated according to a first come first server basis at act 408. When the threshold is exceeded, the group of destination elevators may be operated according to a direct trip process at act 410.

When the process operates in a first come first served process, passengers are assigned to an elevator car in an order of service call requests. From the available elevator car(s), the passengers are assigned to (elevator car)$_N$—the elevator car that will depart next. Passengers will continue to be assigned to (elevator car)$_N$ until one or more customer selectable mode of operation parameters required to select a mode of operation are satisfied. In some processes, the other customer selectable mode of operation parameters may comprise a maximum number of stops during an UP and/or DOWN trip, a maximum number of passengers in an elevator car at one time, a passenger average waiting time, combinations of one or more of these parameters, or any other service quality parameter selectable by a building manager, authorized personnel, or elevator service provider. Once the one or more customer selectable mode of operation parameters are satisfied, (elevator car)$_N$ may depart and operate in accordance with the target service quality parameters that correspond to the selected mode of operation.

Passengers arriving after the one or more customer selectable mode of operation parameters for (elevator car)$_N$ have been satisfied are assigned to (elevator car)$_{N+1}$. Passengers will continue to be assigned to this elevator car, which may use the same target service quality parameters as (elevator car)$_N$, until the one or more customer selectable mode of operation parameters are satisfied for (elevator car)$_{N+1}$. The assignment of passengers may continue using the elevator cars of the group of elevators in a circular manner.

Because the intelligent destination elevator control system collects data for all of the elevators and all of the floors of the building, the process may cause one elevator car (e.g., (elevator car)$_N$) to deny a service call on its DOWN trip so that the elevator car may satisfy its target service quality parameters knowing that another elevator car (e.g., (elevator car)$_{N+2}$) will be able to accept this denied service call and comply with its target service quality parameters. The continued or periodic monitoring of the attributes of the group of elevators allows the intelligent destination elevator control system to update the data retained in the data warehouse, learn new traffic trends for the building, and/or dynamically modify the control of the group of elevators if the elevator cars cannot satisfy the target service quality parameters. Various factors may contribute to an elevator car not satisfying the target service quality parameters. Some exemplary factors may be when a problem exists with the elevator car hardware, or when a passenger holds an elevator car on a floor longer than expected by the system.

Along with monitoring the movement of the individual destination elevator cars, the process may monitor the time and/or distances between the destination elevator cars. Based on the time and/or distance between destination elevators, the process may take corrective action to try and maintain a previously established time-table. For example, if a destination elevator car unexpectedly reaches full passenger capacity during a DOWN stop, and all of the passengers are traveling to the main lobby, the process may detect the full load and direct that this destination elevator car ignore any additional service calls and proceed non-stop to the main lobby. If during the non-stop trip to the main lobby this destination elevator car passes a second destination elevator car that was to arrive before the full car, the process detects that the cars have exchanged their relative position and may now delay the second car so as to maintain a time interval between the destination elevator cars. In some processes the speed of the second elevator may be slowed so as to delay this car's arrival in the main lobby. In other processes, the second car may stop at a floor to answer a service call that was previously assigned to the first car. Other circumstances may cause elevator cars to change relative positions, such as a destination elevator car that has a low reversal floor, a destination elevator car that is delayed by a passenger holding the doors open longer than an expected time period, a hardware and/or software problem, an/or other passenger influenced conditions. In some instances, an output through an elevator display or communication device unique to a passenger may display an approximate time/time period until a passenger's assigned car is to arrive. In the event that the assigned car does not arrive in the approximated time/time period, the passenger may re-request a service call.

When the process determines that the traffic density threshold has been exceeded at act 406, passengers are assigned to the elevator cars based on direct trip patterns at act 410. When the process controls the elevator cars in a direct trip pattern, each of the elevator cars are operated such that each may only service specific floors. The number of floors serviced by each elevator car identifies the pattern. When operated in a direct trip pattern, depending on a passenger's destination, a first arriving passenger may be assigned to an elevator car that will depart after later arriving passengers. For example, if a first elevator car's direct trip pattern services floors 1 (the first floor above the main lobby) to 5, and a second elevator car's direct trip pattern services floors 6 to 10, a first arriving passenger whose destination is floor 9 would be assigned to the second elevator car which would depart after the first elevator car to which a later arriving passenger whose destination is floor 3 may be assigned. A third passenger whose destination is floor 12 may be assigned to a third elevator car that services this floor.

Multiple direct trip patterns may exist to service the same total number of floors, and may depend on the number of elevator cars within the group of elevators. Where multiple direct trip patterns exist, process may select a direct trip pattern that satisfies one or more customer selectable mode of operation parameters.

Figure 5:
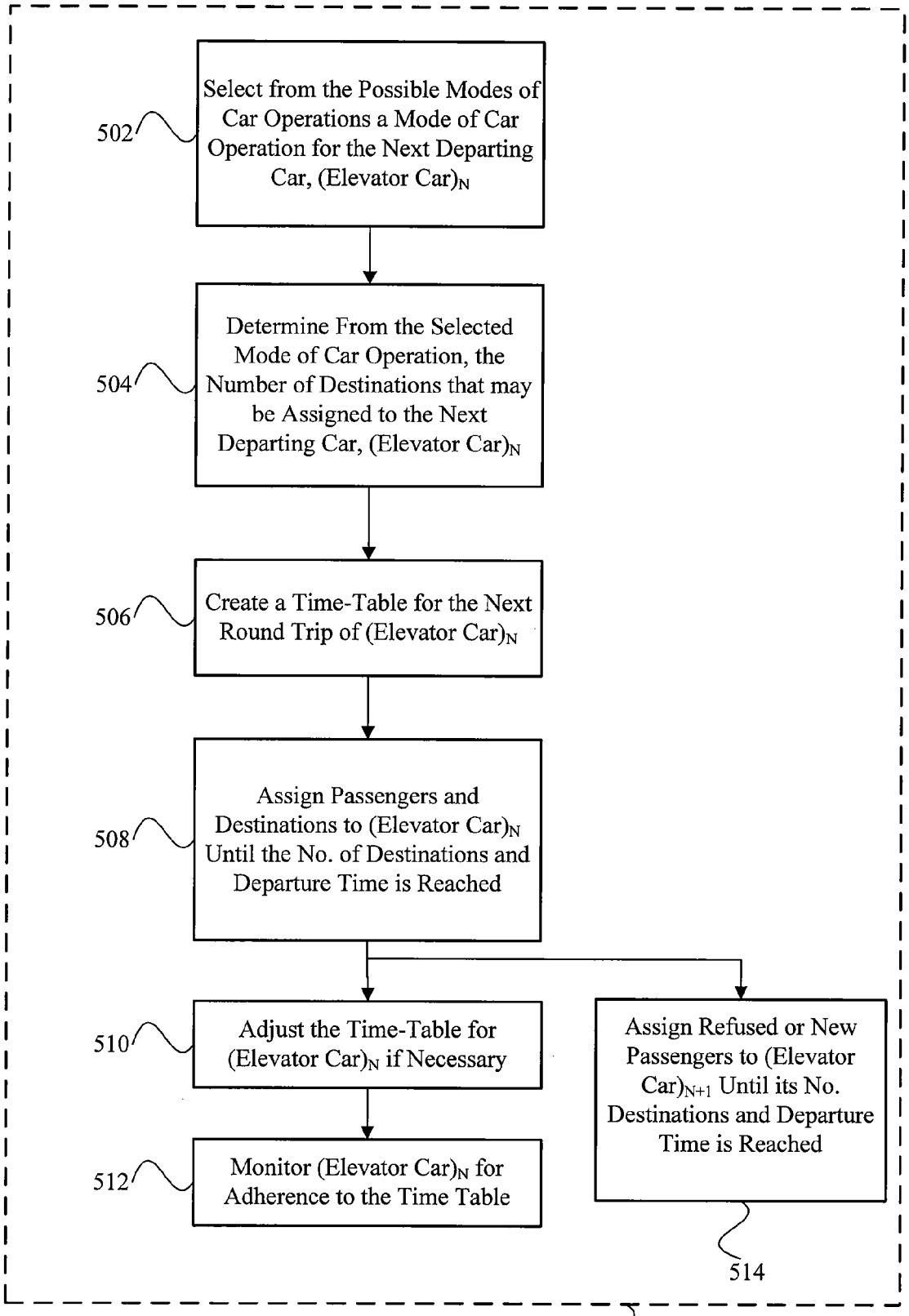
FIG. 5 is an exemplary process that controls a group of destination elevators according to a first come first served process.

FIG. 5 is an exemplary process of assigning passengers to an elevator according to a first come first served process by controlling the number of passengers in each destination elevator car. UP going passengers may have any floor above the main building lobby as their destination, therefore, the intelligent destination elevator control system may be configured for an anticipated UP traffic density (e.g., a first customer selectable mode of operation parameter) to control the number of floors stopped at during an UP trip (e.g., a second customer selectable mode of operation parameter). As shown in FIG. 4, the process has determined at act 402 an anticipated UP traffic density for an upcoming predetermined time period, such as the next about 5 minutes. Based on the anticipated traffic and past experience, the process may estimate the number of stops that are typically requested during the upcoming predetermined time period. The probable number of stops that an elevator car may make on an UP trip may depend on the number of floors within a building and the number of passengers in an elevator car. In some processes, the number of stops an elevator car makes on an UP trip may be monitored and the system may develop through a learning process of past trips a probable number of stops which may be retained in the data warehouse and/or in the comparative performance data structure. Alternatively, the probable number of stops may be determined based on one or more expressions. The results of the calculated probable number of stops may be retained in the data warehouse and may be part of the comparative performance data structure.

At act 502, the process selects from the possible modes of car operations a mode of car operation for the next departing car (e.g., elevator car$_N$). The selected mode of car operation may be based on one or more customer selectable mode of operation parameter. Once the mode of operation for the next departing destination elevator car is selected, the time-table and target service quality parameters are known for this destination elevator.

At act 504 the process determines from the selected mode of car operation the number of destinations that may be assigned to the next departing car. At act 506, a time-table is created for the next roundtrip for the next departing car. The time-table may comprise a roundtrip travel time for the departing elevator car. Additionally, the process may assign the target service quality parameters that correspond to the selected mode of car operation. The target service quality parameters may comprise a time interval between two departing elevator cars, a minimum passenger average waiting time, a number of additional stops that may be accepted along the UP trip based on interfloor traffic, a number of stops for passengers traveling down to the main lobby, and/or a number of additional stops that may be accepted on the DOWN trip for interfloor traffic. The time-table times may be based on the data associated with the selected mode of car operation. At act 508, passengers and their destinations are assigned to the next elevator car. Passengers may be assigned to this next elevator car until the next passenger assigned would exceed the maximum number of passengers corresponding to the selected mode of car operation and until the departure time of the elevator car is reached. Once the limit of passengers or the departure time has been reached, additional passengers will be assigned to the next departing elevator car in the elevator group (e.g., (elevator car)$_{N+1}$). At act 510, the time-table is adjusted if necessary. In some instances, the time-table may need to be adjusted where less than an expected number of destinations or passengers are assigned to the elevator car. The adjustment to the time-table may occur prior to the elevator car's departure.

At act 512, the process may monitor the group of elevator car's adherence to the time-table. The process may apply one or more performance rules while monitoring the destination elevators. In some first come first served processes, the performance rules may be stored in a volatile or non-volatile memory. In some first come first served processes, the performance rules may modify elevator service quality parameters to maintain roundtrip and/or interval times. In other methods, the performance rules may modify elevator service quality parameters to avoid average awaiting times that are less than an predetermined minimum waiting time. In yet other methods, the performance rules may accept or deny additional UP or DOWN stops and cause these additional service requests to be assigned to another elevator within the group. Assignment of these requests to another elevator car may prevent bunching of the elevator cars and assist with the maintenance of the elevator group's adherence to the established time-table. In yet other methods, a combination of these or other performance rules may be employed to control the group of elevators.

At act 514, passengers are assigned to (elevator car)$_{N+1}$. These passengers may include passengers that were refused from (elevator car)$_N$ at act 508. When this is the case, the passengers that were refused from (elevator car)$_N$ will have priority of assignment for (elevator car)$_{N+1}$. Passengers may continue to be assigned to (elevator car)$_{N+1}$ the maximum number of passengers, based on the probable number of stops for (elevator car)$_{N+}$1, are reached. The assignment of passengers may continue to the other elevator cars in the group in a circular manner such that acts 502-514 are followed for each additional elevator car in the group.

Figure 6:
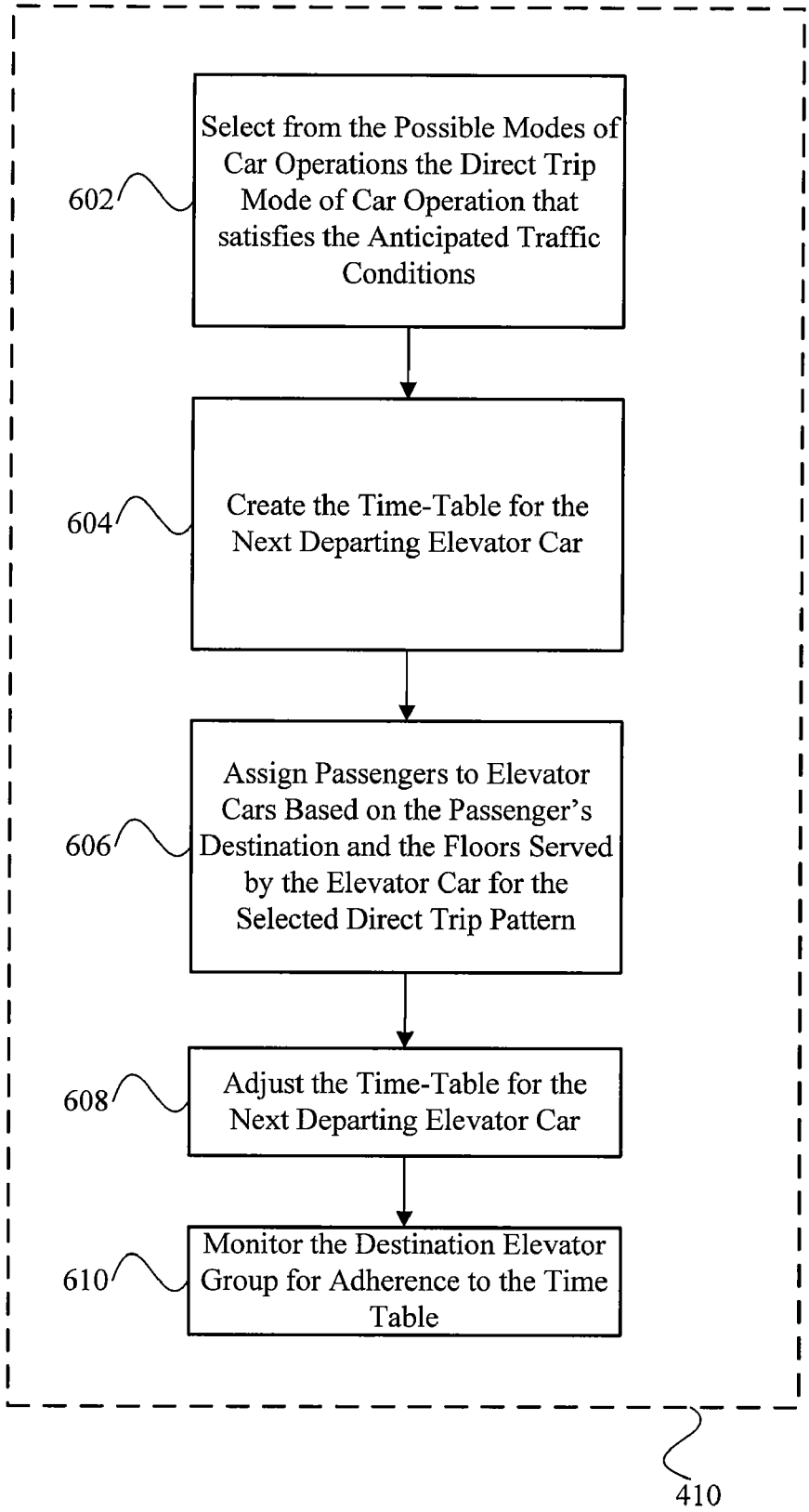
FIG. 6 is an exemplary process that controls a group of destination elevators according to a direct trip process.

FIG. 6 is an exemplary process of controlling a group of destination elevators according to a direct trip pattern. At certain times (e.g., when traffic densities are heavy), elevator cars that serve all of the floors within a building may have many destinations causing many stops and long roundtrip travel times. At act 602 the process may select a direct trip pattern from the possible modes of car operations that will satisfy the anticipated traffic for a predetermined time period (act 402). A direct trip pattern may be a pattern where each elevator car of a group of elevators serves specific floors and omits service to all other floors. Often, there may be multiple direct elevator service patterns that may satisfy the anticipated traffic. In these instances, elevator performance rules stored in a volatile or non-volatile memory may be applied to determine an appropriate direct trip elevator service pattern. The application of the elevator performance rule may be based on a parameter. The customer selectable mode of operation parameter may comprise a roundtrip travel time, a departure interval time, a passenger waiting time, and/or other elevator service quality parameters that may be retained in the comparative performance data structure.

At act 604, a time-table is created for the next roundtrip for the next departing car. The time-table may comprise a roundtrip travel time for the departing elevator car. Additionally, the process may program the target service quality parameters that correspond to the selected mode of car operation. The target service quality parameters may comprise a time interval between two departing elevator cars, a minimum passenger average waiting time, and/or other service quality parameters.

At act 606, passengers may be assigned to an elevator car that will stop at the passenger's desired floor in accordance with the selected direct trip pattern. Depending on the selected direct trip pattern, a passenger may have to wait for one or more elevator cars from the elevator group to depart before the elevator car that will stop at the passenger's desired floor, in accordance with the selected direct trip pattern, departs.

At act 608 the time-table is adjusted if necessary. In some instances, the time-table may need to be adjusted where less than an expected number of destinations or passengers are assigned to the elevator car. The adjustment to the time-table may occur prior to the elevator car's departure.

At act 610, the process may monitor a destination elevator's adherence to the time-table. The process may apply one or more performance rules while monitoring the group of elevators. In some direct trip methods, the performance rules may be stored in a volatile or non-volatile memory. In some direct trip methods, the performance rules may modify elevator service quality parameters to maintain roundtrip and/or interval times. In other methods, the performance rules may modify elevator service quality parameters to avoid average awaiting times that are less than an established minimum waiting time. In yet other methods, the performance rules may accept or deny additional UP or DOWN stops at floors serviced according to the direct trip pattern. Denied service requests may be assigned to another elevator within the group, and the process may update the selected direct trip pattern for a next departing car. Assignment of these requests to another elevator car may assist with the maintenance of the elevator group's adherence to the established time-table. In yet other methods, a combination of performance rules may be employed to control the group of elevators.

FIG. 7 is an exemplary graphical representation of a direct trip pattern. Direct trip patterns may represent a specific mode of car operation, and the pattern demonstrates how a group of destination elevators may distribute their service qualities over a series of floors. In FIG. 7, the pattern demonstrates how a group of destination elevators may distribute their service qualities equally over 12 floors by making 12 consecutive trips to 5 floors each. The pattern shown in FIG. 7 may be considered a direct trip pattern because the floors served during consecutive trips of the group of destination elevators do not overlap. In FIG. 7, the floors which may be served by consecutively departing elevators car from the main lobby are shown. During a first trip, the first destination elevator car services floors 1 through 5. During a second trip, a second destination elevator car services floors 6 through 10. During a third trip, a third destination elevator car services floors 11 and 12 and floors 1 through 3. Adherence to the pattern may continue with passengers being assigned to destination elevator cars that will service the passengers' destination. During the 12 trips shown in FIG. 7, each floor is serviced 5 times. Although 12 trips are shown in FIG. 7, a group of elevators do not have to complete all trips of a direct trip pattern. When traffic conditions change, a next departing car may use a different direct trip pattern or other mode of car operation (e.g., a first come first served, etc.).

Multiple direct trip patterns may be created based on the number of floors in a building that are served by a group of destination elevators. Each different pattern may provide slightly different time-tables and target service quality parameters, and the pattern used may be selected in accordance with a customer selectable mode of operation parameter. In some systems, direct trip patterns may be used to control the elevator cars of a group of destination elevators when a customer selectable traffic density threshold is exceeded. In other systems, direct trip patterns may be used to control the elevator cars of a group of destination elevators during emergency situations, such as the evacuation of one or more floors of a building.

Figure 8:
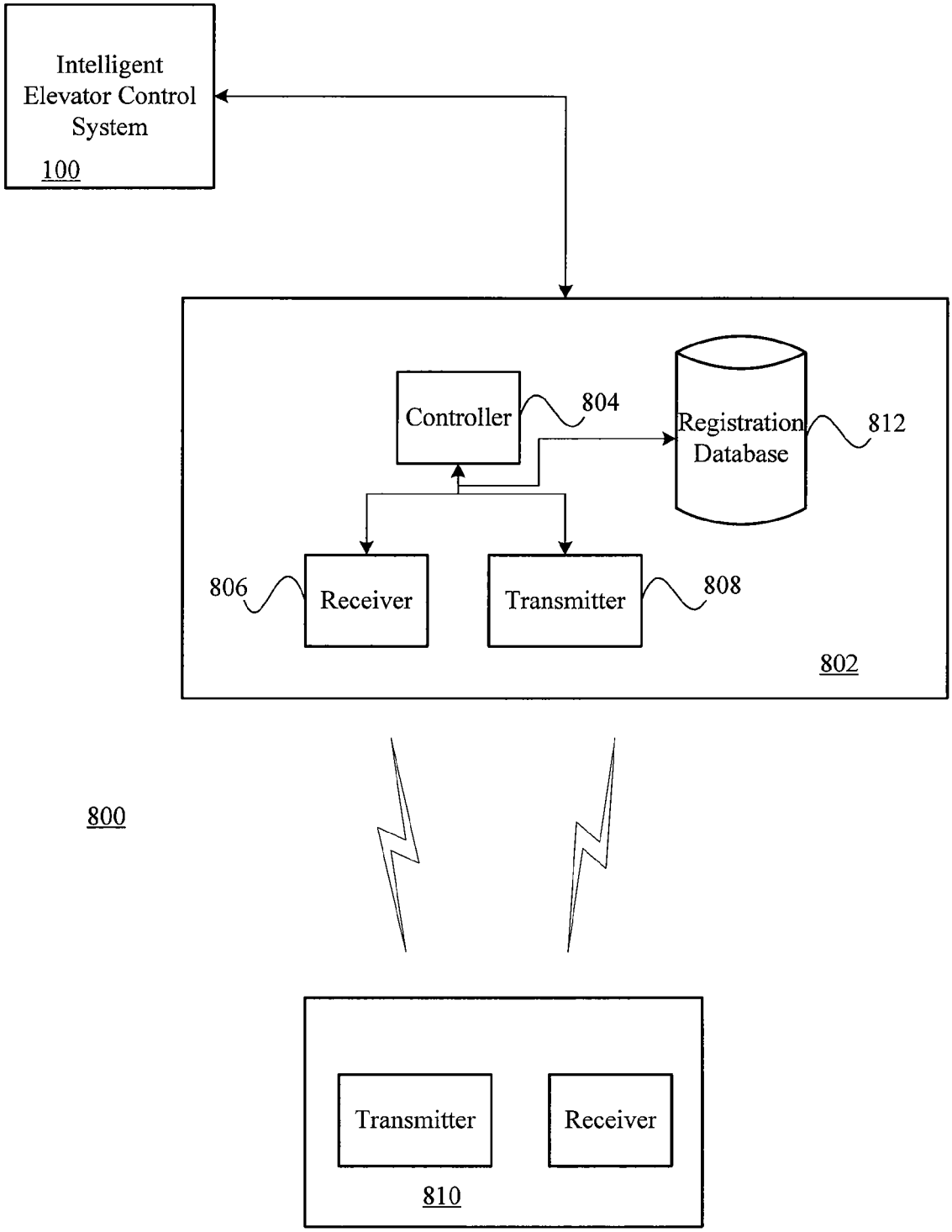
FIG. 8 is a second exemplary system of an intelligent destination elevator control system.

FIG. 8 is an alternate intelligent destination elevator control system 800. In FIG. 8, a lobby network 802 may communicate with the intelligent destination elevator control system processor 110. The lobby network 802 may include a controller 804 which may be part of a local area network or a wide area network. The lobby network 802 may receive data from and/or transmit data to a personalized passenger device 810 through receiver 806 and/or transmitter 808. In some systems, the personalized passenger device 810 may comprise a handheld device that combines computing, telephone, facsimile, electronic mail, appointment scheduling, and/or networking features. In other systems, the personalized passenger device 810 may comprise a device for transmitting and/or receiving alpha-numeric message.

As shown in FIG. 8, communication between the lobby network 802 and the personalized passenger device 808 may be through a wireless communication medium. In some systems, the wireless communication mediums may be radio frequency signals, but other wireless communication mediums may be used as well. In other systems, the personalized passenger device 808 may be inserted into an interface/docking station and communication with the lobby network 802 may be through a wired communication medium. For security purposes, communications exchanged between the lobby network 802 and the personalized passenger device 808 and/or the lobby network 802 and the intelligent destination elevator control system 100 may be encrypted. In some systems, a lobby network 802 may be present on each floor of a building. In other systems, a lobby network receiver, transmitter, and/or docking interface may be present on each floor of a building while other components of the lobby network may be remotely located.

In some systems, when the personalized passenger device 808 is in proximity to the receiver 804 and/or transmitter 806 of the lobby network 802 (or when docked with the lobby network interface) data may be exchanged to register the passenger's arrival in the lobby. Registration of a passenger may include verifying that the passenger is an authorized person within the building. Verification may include accessing a database 812 that comprises individual's names, companies, destinations which the individual may access, time periods during which the individual may access specific destinations, an individual's "home" floor, and/or a time of arrival and/or departure. Visitors to the building may be required to receive a personalized passenger device 808 from a security or reception desk which may be programmed to define when and to which floors the visitor may travel. In situations where a passenger leaves an elevator car on an unauthorized floor, the lobby network 802 may identify this unauthorized access and generate a feedback message. The feedback message may be an audio, visual, and/or tactile message that may be received at the personalized passenger device 808 and/or at a reporting module that is part of the intelligent destination elevator control system 100. If the individual on the unauthorized floor does not respond to the feedback message and/or correct the unauthorized access within a predetermined time period, the system may transmit a security warning to security, building management, and/or other authorized personnel to indicate the unauthorized access.

In some systems, upon registration, the system may automatically determine a destination for an individual and assign the individual to a specific elevator car. Some systems may determine an individual's destination based on a time of day, week, month, and/or season. In other systems, upon registration an individual may manually enter a desired destination through its personalized passenger device 808. In response to the entry of the individual's desired destination, the system may assign the individual to a specific elevator car or may change a passenger's desired destination.

The methods and descriptions of FIGS. 4-6 may be programmed in one or more servers, distributed between one or more servers or may be encoded in a signal-bearing storage medium or a computer-readable medium. A signal-bearing medium or a computer-readable medium may comprise a memory that is unitary or separate from a device, programmed within a device, such as one or more integrated circuits, or retained in memory and/or processed by a controller or a computer. If the methods are performed by software, the software or logic may reside in a memory resident to or interfaced to one or more processors or controllers that may support a tangible communication interface, wireless communication interface, or a wireless system. The memory may include an ordered listing of executable instructions for implementing logical functions. A logical function may be implemented through digital circuitry, through source code, or through analog circuitry. The software may be embodied in any computer-readable medium or signal-bearing medium, for use by, or in connection with, an instruction executable system, apparatus, and device that controls a group of destination elevators. Such a system may include a computer-based system, a processor-containing system, or another system that includes an input and/or output interface that may communication with a publicly distributed network through a wireless or tangible communication bus though a public and/or proprietary protocol.

A "computer-readable storage medium," "machine-readable medium," "propagated-signal medium," and/or "signal-bearing medium" may comprise any medium that contains, stores, communicates, propagates, or transports software for use by or in connection with an instruction executable system, apparatus, or device. The machine-readable medium may selectively be, but is not limited to, an electronic, magnetic, optical, electromagnetic, infrared, or semiconductor system, apparatus, device, or propagation medium. A non-exhaustive list of examples of machine-readable medium includes: an electrical connection having one or more wires, a portable magnetic or optical disk, a volatile memory, such as a Random Access memory (RAM), a Read-Only Memory (ROM), an Erasable programmable Read-Only Memory (EPROM or Flash memory), or an optical fiber. A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A computer implemented method that facilitates operation of a group of destination elevators, comprising:

retaining a data structure, in a data warehouse, that represents modes of operations of a group of destination elevators that satisfy predetermined traffic conditions, the modes of operations comprising timing parameters for operating the group of destination elevators;

identifying a subset of modes of operations from the data warehouse based on a first selected operation parameter;

selecting a mode of operation from the subset of modes of operations that satisfies a second selected operation parameter;

programming a processor with a timing parameter based on the selected mode of operation, the processor driving an elevator control system that operates the group of destination elevators; and assigning passengers to one of an elevator in the group of destination elevators until a maximum number of destinations provided by the selected mode of operation is reached.

2. The method of claim 1, further comprising assigning passengers to the elevator in the group of destination elevators until a maximum number of additional stops on a downward trip is reached, the maximum number being defined by the selected mode of operation.

3. The method of claim 2, further comprising monitoring a period of time that a first elevator in the group of destination elevators is at a destination floor.

4. The method of claim 3, further comprising adjusting the mode of operation for a second elevator in the group of destination elevators when the first elevator in the group of destination elevators remains at the destination floor beyond a predetermined stopping threshold time period, and programming the processor with the mode of operation for the second elevator.

5. The method of claim 1, where the timing parameter based on the selected mode of operation is a round trip travel time for a next departing elevator in the group of destination elevators.

6. The method of claim 5, further comprising monitoring the round trip travel time for the next departing elevator in the group of destination elevators.

7. The method of claim 6, further comprising dynamically adjusting the data structure with an updated round trip travel time of the one of the elevator in the group of destination elevators.

8. The method of claim 1, further comprising selecting a second mode of operation for a next departing elevator in the group of destination elevators when a transport capacity parameter of the one of the elevator will not satisfy anticipated transportation demand, and programming the processor with the second mode of operation for the next departing elevator.

9. The method of claim 8, where the second mode of operation comprises a direct trip pattern to one or more selected destinations.

10. The method of claim 1, further comprising dynamically adjusting the data structure with updated timing parameters for the one of the elevators in group of destination elevators based on the operation of the one of the elevator in the group of destination elevators.

* * * * *